US008221151B2

(12) United States Patent
Fujisaki

(10) Patent No.: US 8,221,151 B2
(45) **Date of Patent: *Jul. 17, 2012**

(54) CONNECTOR-MOUNTING CONSTRUCTION

(75) Inventor: Ryuichi Fujisaki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 227 days.

This patent is subject to a terminal disclaimer.

(21) Appl. No.: 12/776,602

(22) Filed: May 10, 2010

(65) Prior Publication Data

US 2010/0291789 A1 Nov. 18, 2010

(30) Foreign Application Priority Data

May 13, 2009 (JP) ..... 2009-116732

(51) Int. Cl.
*H01R 13/627* (2006.01)

(52) U.S. Cl. ..... 439/357; 439/35

(58) Field of Classification Search ..... 439/34, 439/35, 357–358, 352, 566, 567, 570
See application file for complete search history.

(56) References Cited

U.S. PATENT DOCUMENTS

| | | | | |
|---|---|---|---|---|
| 6,695,621 | B1 * | 2/2004 | Wang | 439/35 |
| 6,749,438 | B1 * | 6/2004 | Scheller et al. | 439/35 |
| 7,331,792 | B2 * | 2/2008 | Cummings et al. | 439/35 |
| 7,347,725 | B2 * | 3/2008 | Sakamoto | 439/566 |
| 7,435,125 | B2 | 10/2008 | Cummings et al. | |
| 2010/0291797 | A1 * | 11/2010 | Fujisaki | 439/569 |

* cited by examiner

*Primary Examiner* — Xuong Chung Trans
(74) *Attorney, Agent, or Firm* — Gerald E. Hespos; Michael J. Porco

(57) ABSTRACT

A connector-mounting construction has a bracket (10) with a mounting hole (12) and a to-be-locked plate (13) adjacent to the mounting hole (12). A connector (20) has an end configured for insertion through the mounting hole (12) and a flange (27) dimensioned contacting the rear surface of the bracket (10). An insertion groove (35) extends into the flange (27) parallel to a front surface of the flange (27). A metal lock (50) has an insertion portion (60) in the insertion groove (35) and a locking piece (51) projecting forward along a side of the connector (20). The locking piece (51) has at least one resiliently deformable locking projection (55) with a rearwardly facing locking surface (56) configured for locking edge forwardly facing edge (14) the to-be-locked plate (13) of the bracket (10) when the flange (27) of the connector (20) contacts the rear surface of the bracket (10).

6 Claims, 11 Drawing Sheets

CONNECTOR-MOUNTING CONSTRUCTION

BACKGROUND OF THE INVENTION

1. Field of the Invention

The invention relates to a construction of mounting a connector on a mounting plate such as a bracket.

2. Description of the Related Art

U.S. Pat. No. 7,435,125 discloses a connector for electrically connecting a towing car and a car to be towed. The connector for the towing car is mounted on a bracket provided vertically on a lower portion of a rear end of the body of the towing car.

The connector for the towing car has a fit-in portion with an opening and a closing lid disposed at a rear end of the fit-in portion. A mating connector of the car to be towed is fit in the fit-in portion. The fit-in portion is inserted into a mounting hole formed in the bracket from a front end of the connector. A flange is formed on the peripheral surface of the connector and is capable of contacting the edge of the mounting hole of the bracket from the rear of the bracket. A metal elastic locking piece also is mounted on the peripheral surface of the connector and can lock the edge of the mounting hole from the front of the bracket. The elastic locking piece extends rearward from the front end thereof.

The front end of the connector for the towing car is inserted into the mounting hole of the bracket from the rear and the bracket causes the locking piece of the connector to displace elastically. The elastic locking piece elastically returns to its original state when the flange contacts the rear of the bracket at the edge of the mounting hole. The front end of the elastic locking piece locks the edge of the mounting hole from the front. Thus, the connector for the towing car is mounted on the vertically disposed bracket.

The lower end of the elastic locking piece on the connector of the conventional connector-mounting construction forms a short cantilevered insertion portion facing the front of the elastic locking piece. An insertion groove faces rearward on the periphery of the connector. The insertion portion is press fit into the insertion groove so that the elastic locking piece is cantilevered rearward on the connector.

A pull force directed rearward toward the car to be towed may act on the above-described connector for the towing car. As noted above, the connector for the towing car is mounted on the bracket with the elastic locking piece locking the front of the bracket at edge of the mounting hole. The pull force applies a load to the elastic locking piece in a direction to remove the insertion portion from the insertion groove. The insertion portion is press-fit into the insertion groove with a wedge at the side edge of the insertion portion cutting into the wall of the insertion groove. However, there is a fear that the elastic locking piece will be removed from the insertion groove if the connector is pulled with a great force.

The present invention has been completed in view of the above-described situation. It is an object of the invention to allow a locking piece to hold a connector with a great force and the connector to be mounted on a bracket at a high mounting strength.

SUMMARY OF THE INVENTION

The invention relates to a connector-mounting construction including a mounting plate and a connector. The mounting plate has a bracket with a mounting hole. The connector has opposite first and second ends. The first end of the connector has a fit-in portion to be fit on a mating connector. The second end of the connector is configured to be inserted into the mounting hole of the mounting plate from front side of the mounting plate. A flange is provided on a periphery of the connector and can contact the front surface of the mounting plate at an edge adjacent the mounting hole in an insertion direction of the connector. At least one metal locking piece is disposed on the periphery of the connector and extends along the insertion direction. The locking piece is elastically displaceable and is capable of locking a rear part of the mounting plate adjacent the mounting hole. The second end of the connector is inserted into the mounting hole of the mounting plate, thereby causing the locking piece to deform elastically. The locking piece elastically returns to an original state thereof when the flange contacts the front of the mounting plate and locks to the rear of the mounting plate for mounting the connector on the mounting plate. An insertion portion is formed at a proximal end (lower end) of the locking piece by perpendicularly bending the locking piece. An insertion groove is formed on the periphery of the connector and faces in a radial direction approximately orthogonal to the insertion direction of the connector. The locking piece is disposed on the periphery of the connector in the posture along the insertion direction of the connector with the insertion portion being held inside the insertion groove after the insertion portion is inserted therein.

In the above-described construction, the insertion portion of the locking piece is inserted into the insertion groove in the direction orthogonal to the insertion and removal directions of the connector. Therefore, the insertion portion is received by the insertion groove and is in contact with the bottom of the insertion groove even though a large force acts on the connector. Accordingly, the locking piece hardly slips off the insertion groove and the connector can be mounted on the bracket at a high mounting strength.

The insertion groove may be formed on the flange of the connector. Thus, the insertion groove may be formed deeply by utilizing a dead space of the flange, thereby preventing more strongly preventing the locking piece from slipping off the insertion groove.

The insertion portion of the locking piece preferably is press fit into the insertion groove to simplify mounting the locking piece on the connector.

The at least one locking piece preferably comprises two locking pieces provided at both sides of an axial line of the connector. The connector is inserted into the mounting hole of the mounting plate with the connector elastically displacing both locking pieces. Both locking pieces elastically return to the original state when the flange contacts front of the mounting plate at the edge of the mounting hole, thus locking to the rear of the mounting plate. Hence, the connector can be mounted on the bracket in one movement.

The locking piece may be provided at only one position. A projection may be provided on the periphery of the connector at a position opposite to the position where the locking piece is disposed with respect to an axial line of the connector. Thus, the mounting plate may be sandwiched between the projection and the flange The connector is mounted on the bracket by inserting one side of the connector into the mounting hole of the mounting plate with the connector taking an oblique posture to sandwich a predetermined position of the edge of the mounting hole between the flange and the projection. The connector then is pivoted about a sandwiching portion and into a vertical posture. Thus, the connector is inserted deep into the mounting hole while elastically displacing the locking piece and turning the oblique posture to the vertical posture. The locking piece elastically returns to its original state when the flange aligns vertically and contacts the front of the mounting plate. Thus, the locking piece engages the edge of the mounting plate opposite to the edge that has been sandwiched between the flange and the projection. In this manner, the connector is mounted on the bracket. This construction is convenient in mounting a connector having a form in which an electric wire is drawn from the other end by bending the electric wire sideways on the bracket.

A guide preferably is provided at the side of the periphery of the connector that has the locking piece. The guide slides in contact with the edge of the mounting hole of the mounting plate when the connector is pivoted about a sandwiching portion between the flange and the projection to guide a pivotal motion of the connector. Thus, the connector can be pivoted smoothly about the sandwiching portion and mounted promptly on the bracket.

The insertion portion of the locking piece is not likely to slip off the insertion groove of the connector. Thus the connector can be mounted on the bracket at a high mounting strength.

DETAILED DESCRIPTION OF THE PREFERRED EMBODIMENTS

Figure 1:
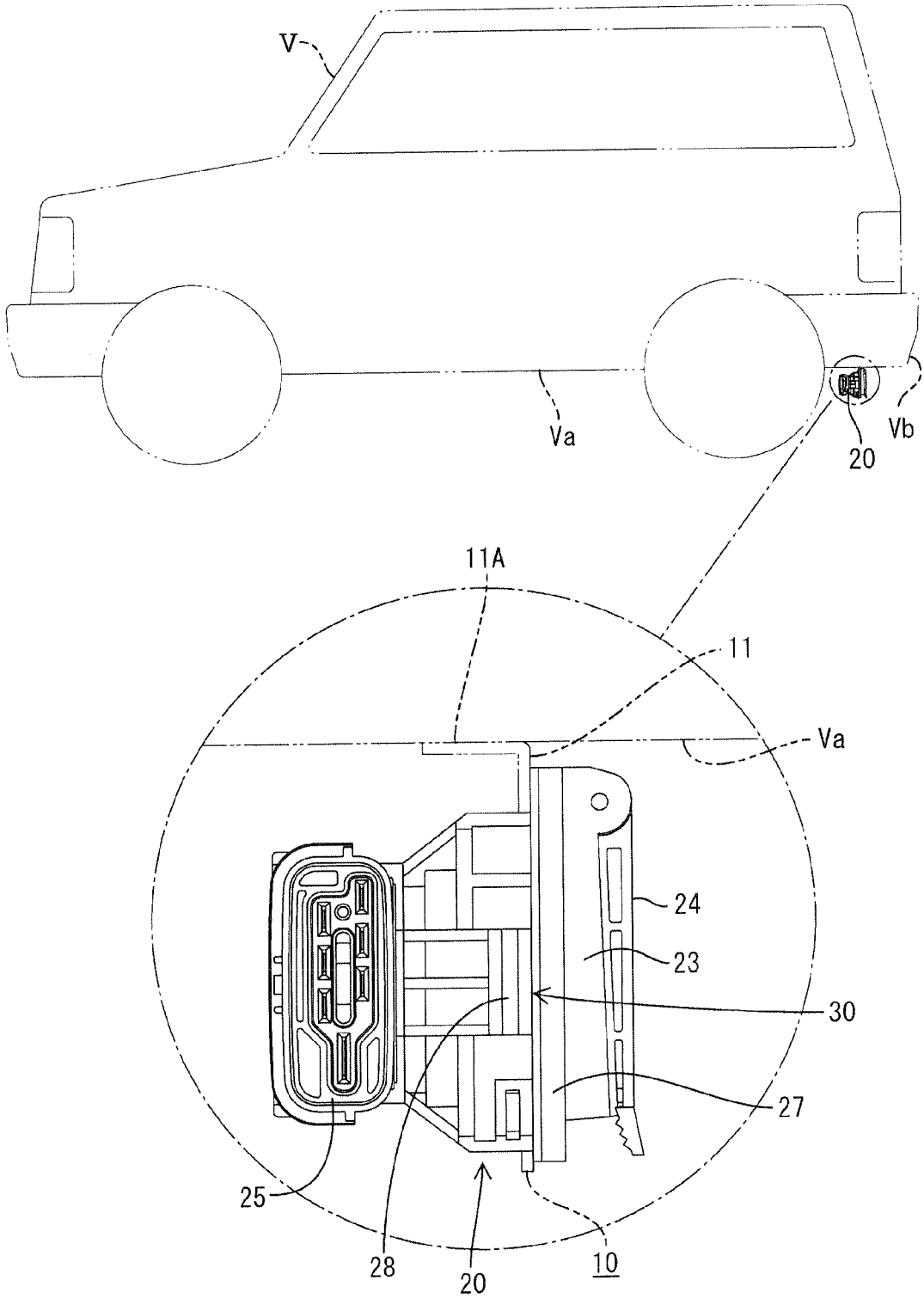
FIG. 1 is a left-hand side view showing a state in which a connector of one embodiment of the present invention is mounted on a car body.

A connector in accordance with the invention is identified by the numeral 20 in FIG. 1 and is used for electrically connecting a car V (towing car) to a trailer (car to be towed) disposed behind the car V. The car V has a body Va and the connector 20 is disposed on a lower portion of a rear end of a car body Va of the car V via a bracket 10.

The bracket 10 is formed by press-molding a metal plate to define an inverted L-shape. More particularly, the bracket 10 has a vertically aligned body plate 11 and a mounting portion 11A that is bent to extend perpendicularly forward from the upper end of the body plate 11. The mounting portion 11A of the bracket 10 is mounted on a lower surface of a rear end of the car body Va at a position near and below the rear bumper Vb so that the body plate 11 extends vertically and along a width direction of the car body Va.

Figure 2:
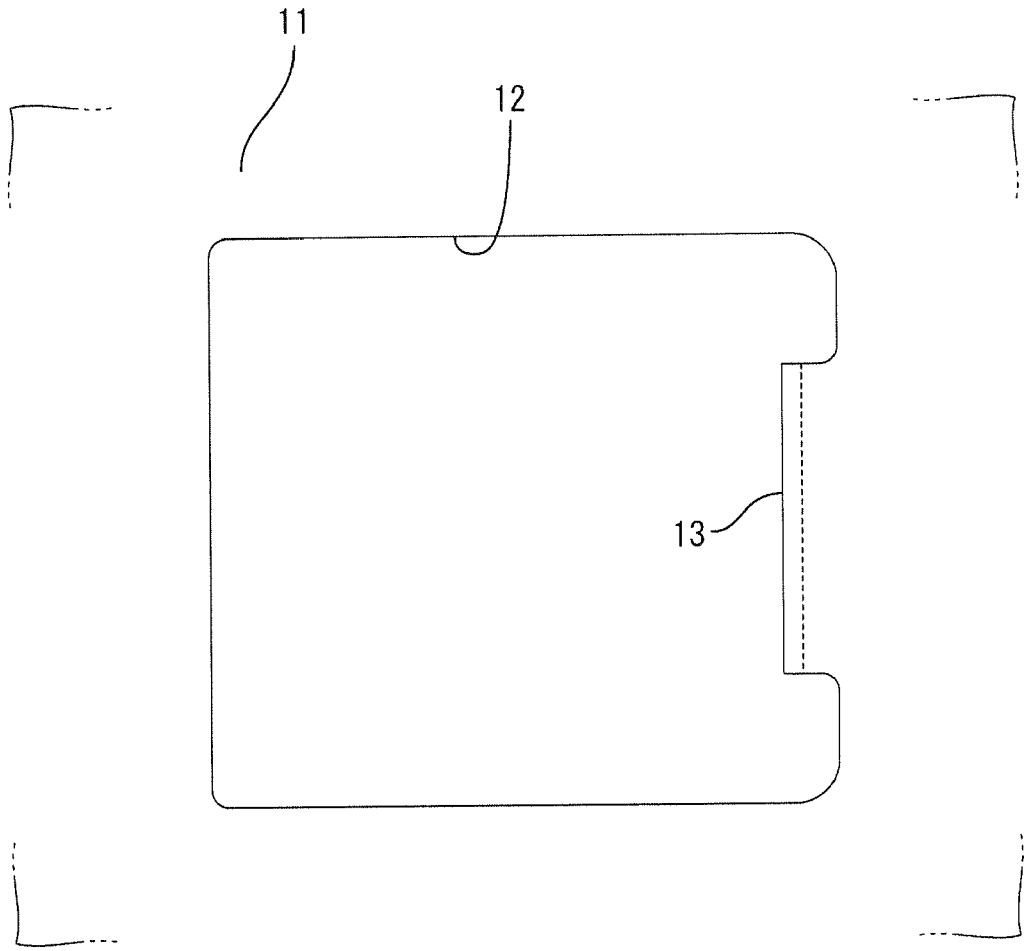
FIG. 2 is a front view showing a bracket.
Figure 9:
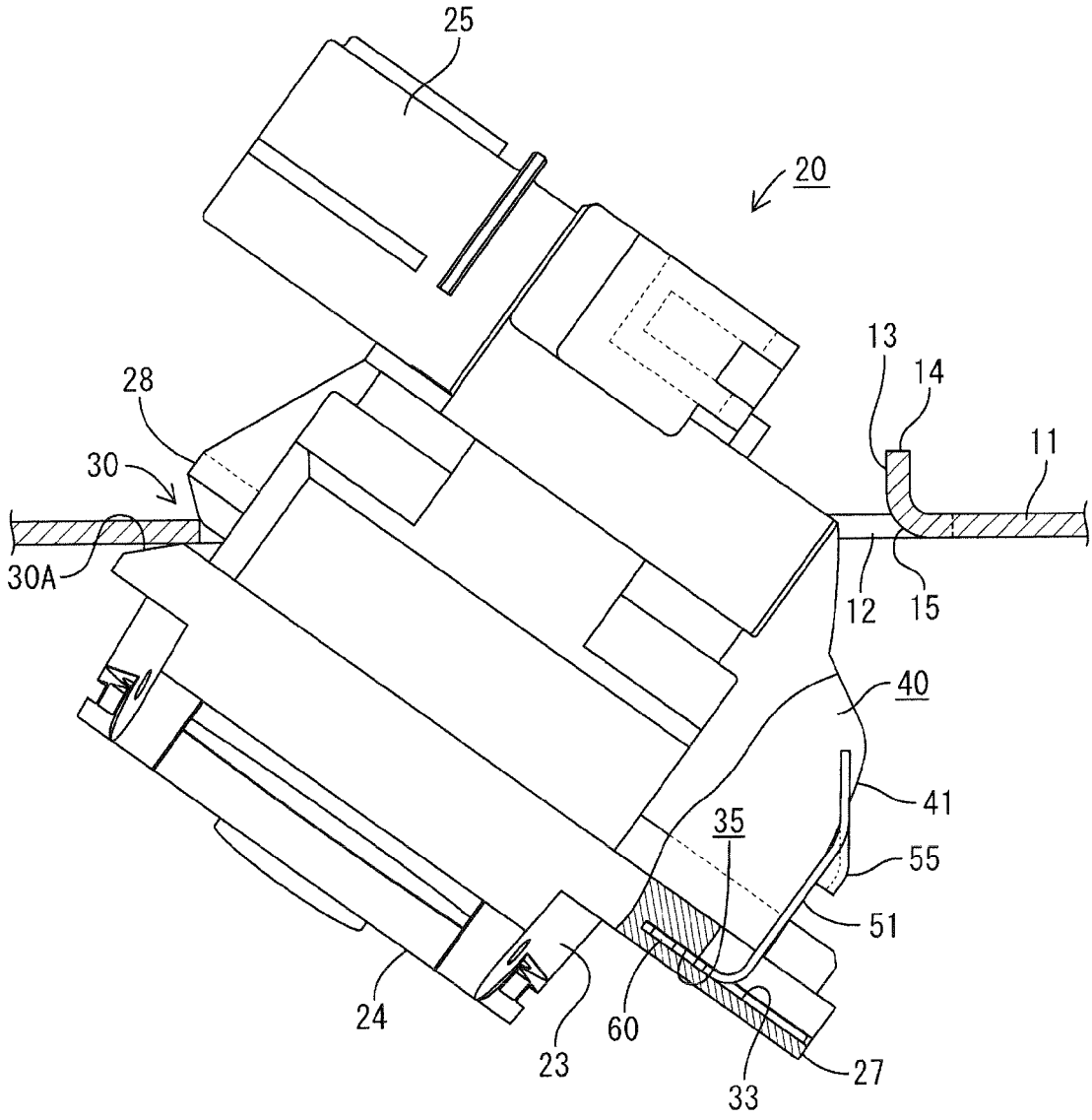
FIG. 9 is a partly cut-away plan view showing an early stage in an operation of mounting the connector on the bracket.

A generally rectangular mounting hole 12 is formed through the body plate 11, as shown in FIG. 2, and has a horizontal dimension slightly longer than the vertical dimension. A to-be-locked plate 13 projects in from the right side of the mounting hole 12, as viewed from the rear, and then is bent perpendicularly forward to define a hook shape, as shown in FIG. 9. The to-be-locked plate 13 is in a central height region of the mounting hole 12 and has a vertical extent equal to about one half of the height of the mounting hole 12. A to-be-locked edge 14 is defined at the forward end of the to-be-locked plate 13 and is to be locked to a locking piece 51 to be mounted on the connector 20, as explained below. A rounded portion 15 is defined at an outer surface of a bent portion of the to-be-locked plate 13.

Figure 4:
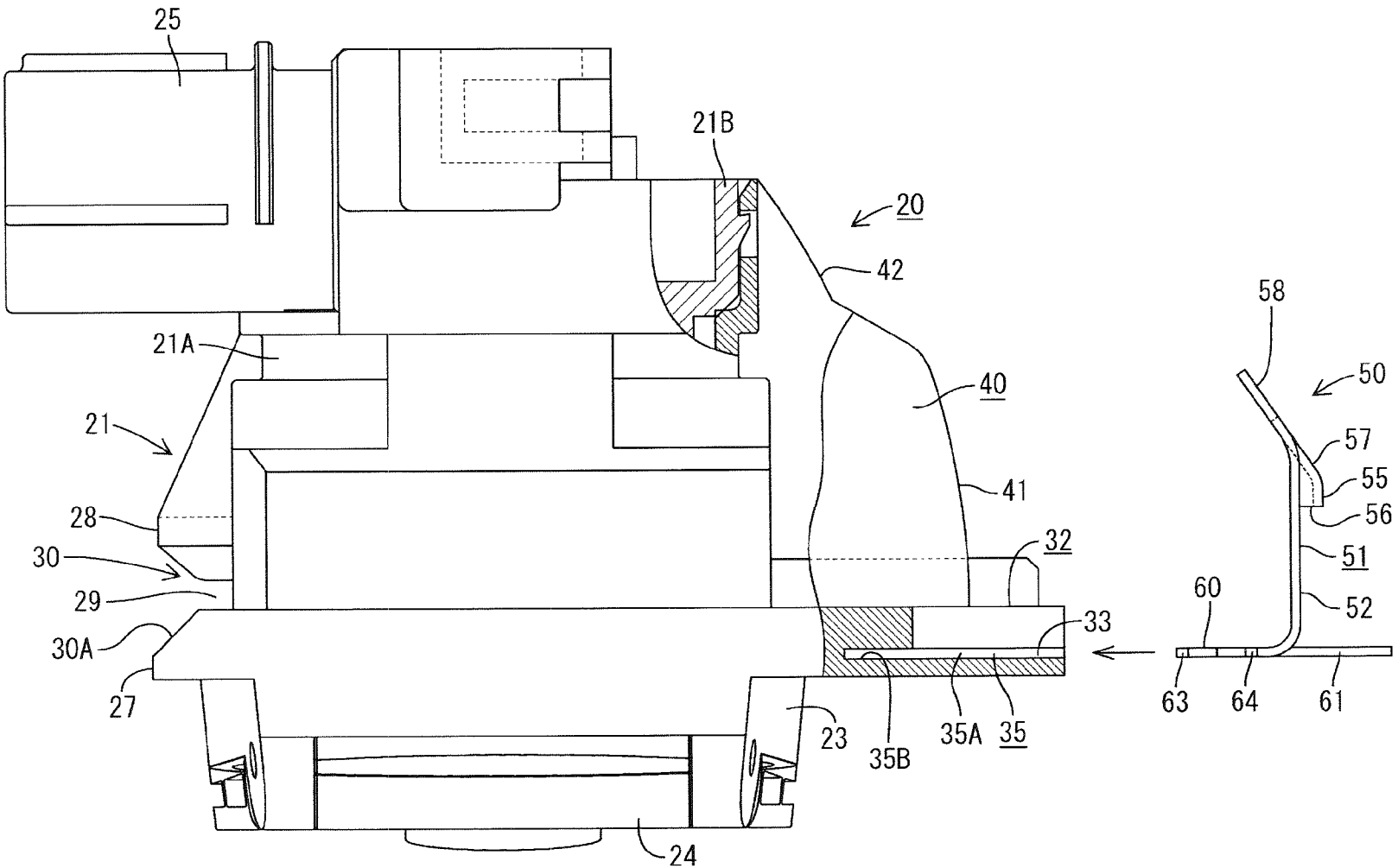
FIG. 4 is a partly cut-away plan view showing an operation of mounting a locking member on the connector.

The connector 20 has a housing 21 made of a synthetic resin. The housing 21 has a front end at the top in FIG. 4 and a rear end at the bottom in FIG. 4. A main housing 21A is defined at a rear part of the housing 21 and a sub-housing 21B is connected integrally to the main housing 21A to define a front part of the housing 21, as shown in FIG. 4.

A rear fit-in portion 23 is formed at a rear end of the housing 21. A mating connector (not shown) connected with a terminal of a wire harness drawn from the trailer can be fit in and connected to the rear fit-in portion 23. As shown in FIG. 1, a lid 24 is mounted pivotally on an upper edge of the rear fit-in portion 23.

A front fit-in portion 25 is formed at the front end of the housing 21 and extends perpendicularly to the left, as viewed from the rear. A connector connected with a wire harness drawn from the car V is fit in and connected to the front fit-in portion 25.

A terminal fitting (not shown) is mounted inside the housing 21 between the front fit-in portion 25 and the rear fit-in portion 23.

Figure 3:
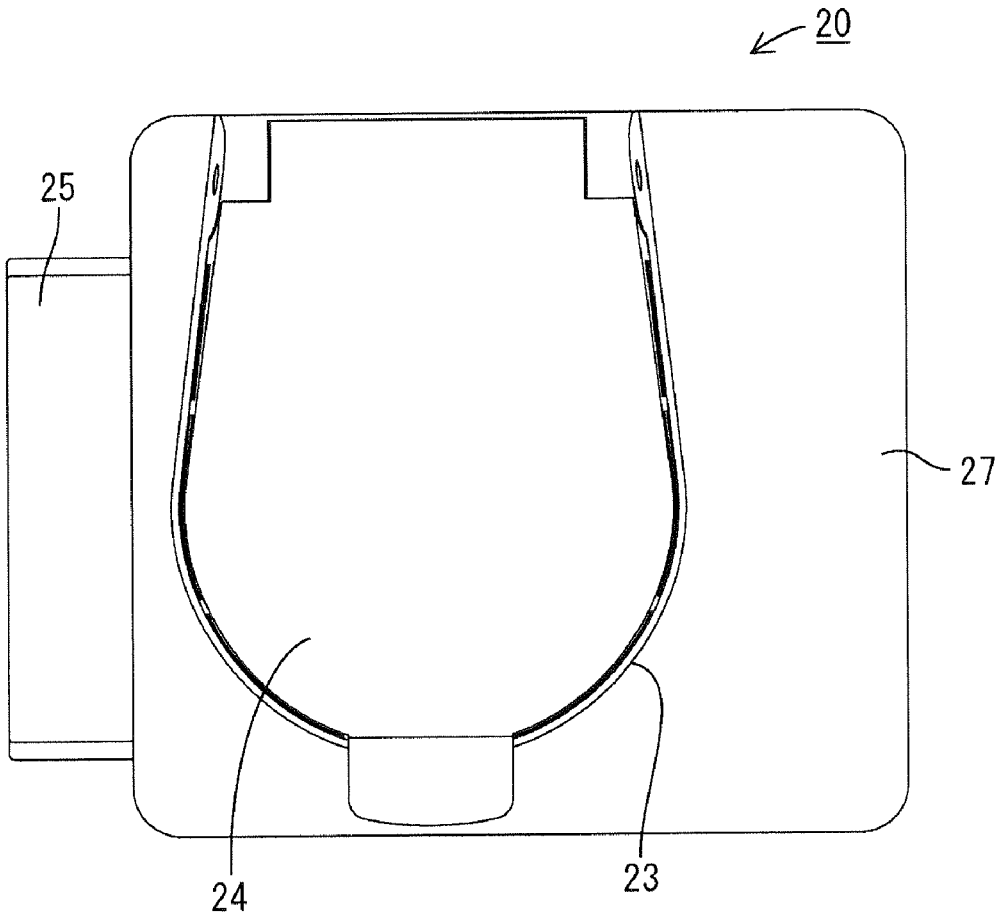
FIG. 3 is a front view showing the connector.

A flange 27 projects out from a peripheral surface of the housing 21 at a position near the rear end of the housing 21 and is more than twice as thick as the bracket 10. As shown in FIG. 3, the flange 27 is a wide rectangle that protrudes in a large area at a right side of the housing 21 and is slightly larger than the mounting hole 12 of the bracket 10.

As shown in FIGS. 1 and 4, a projection 28 protrudes from the left peripheral surface of the housing 21 at a predetermined height. The projection 28 is spaced forward from a left edge of the flange 27 by a distance slightly larger than the thickness of the bracket 10 to define a gap 29 that can receive an edge of the bracket 10 adjacent the mounting hole 12. More particularly, an edge of the bracket 10 at a central height portion of the mounting hole 12 and at a left side of the mounting hole 12 can fit in the gap 29 to be sandwiched between the flange 27 and the projection 28 with a clearance provided between the edge of the mounting hole 12 and the inner peripheral surface of the gap 29. The space between the left-hand edge of the flange 27 and the projection 28 is referred to herein as a sandwiching portion 30.

An outwardly flared inviting portion 30A is defined at an entrance to the sandwiching portion 30 by forming chamfers at a corner of the projection 28 and at a corner of a front surface of the flange 27 opposed to the projection 28.

Figure 5:
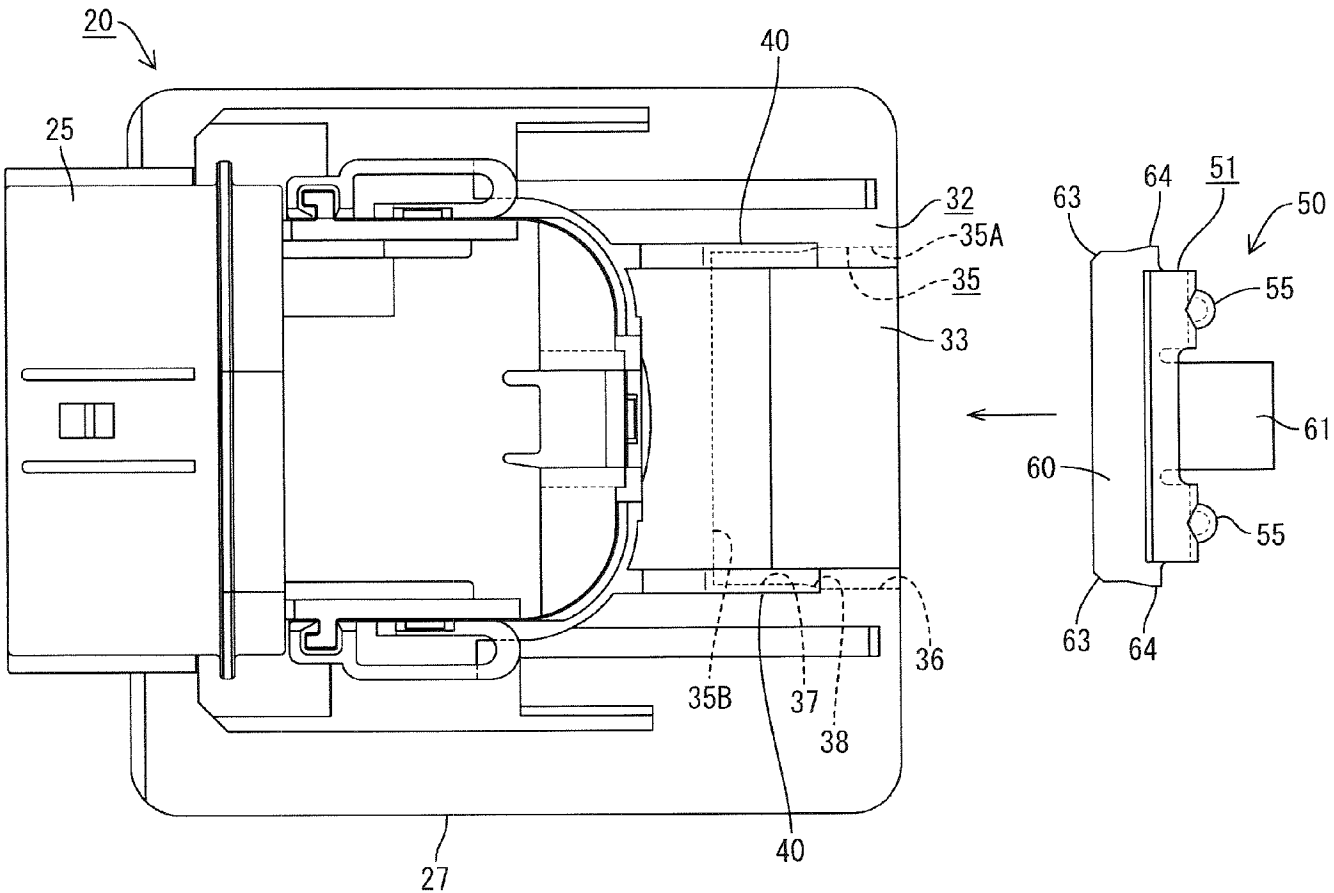
FIG. 5 is a rear view showing the operation of mounting the locking member on the connector.
Figure 6:
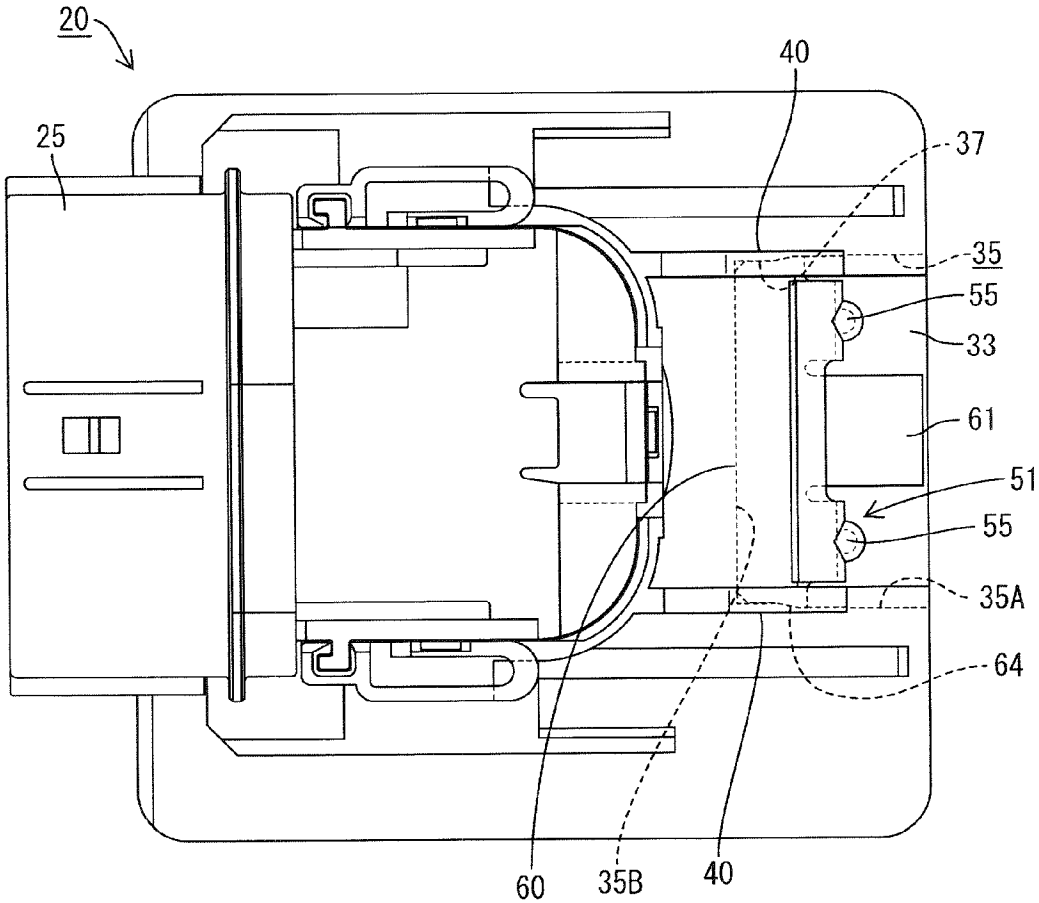
FIG. 6 is a rear view showing a state in which the locking member is mounted on the connector.
Figure 7:
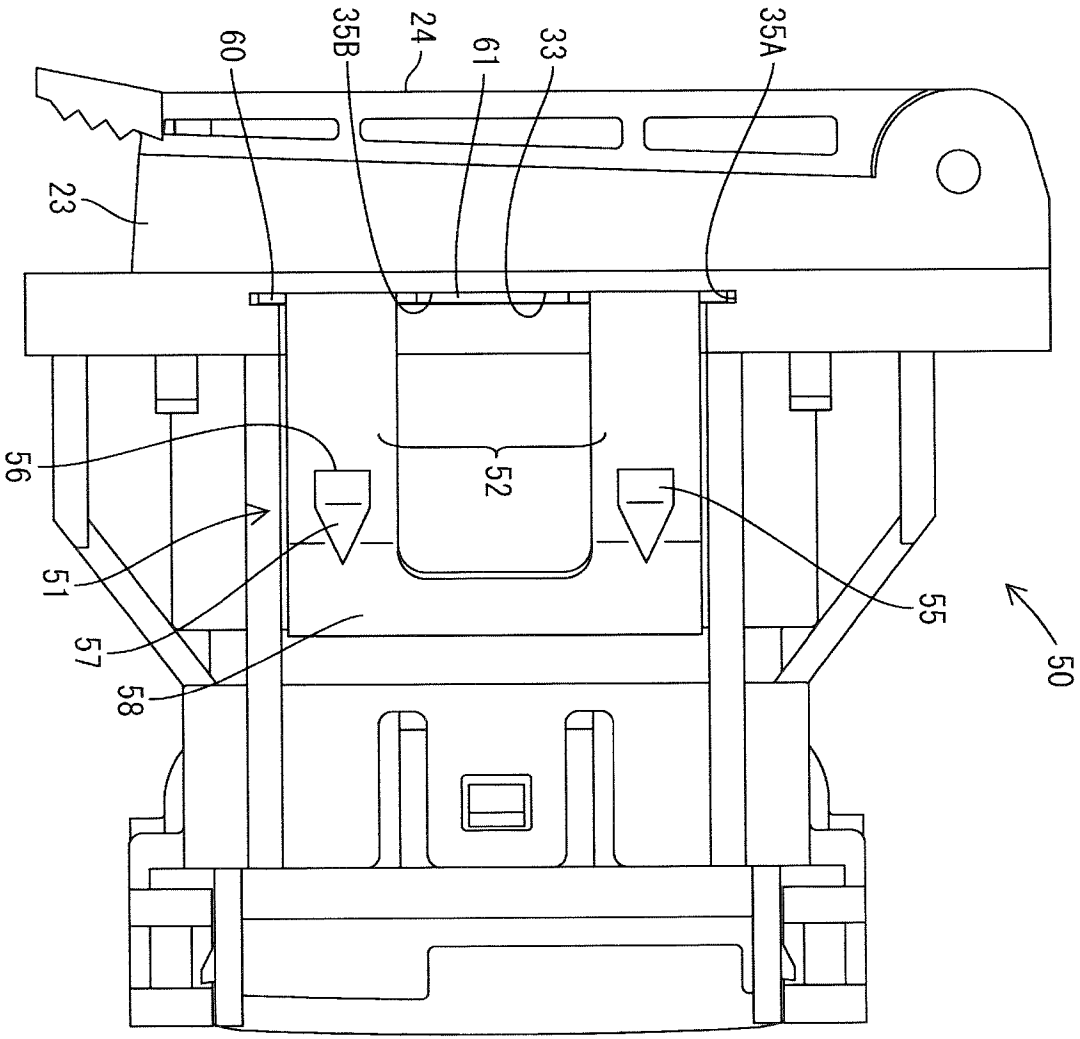
FIG. 7 is a right-hand side view showing the state in which the locking member is mounted on the connector.
Figure 8:
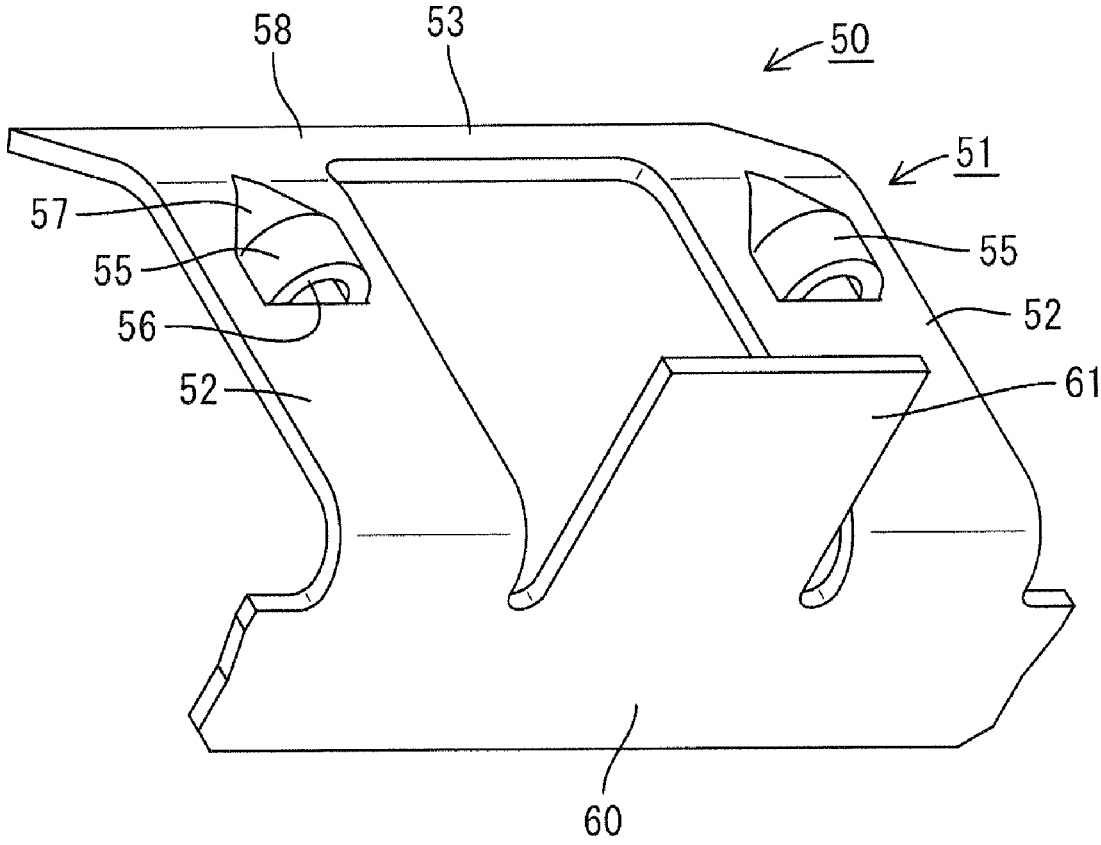
FIG. 8 is a perspective view showing the locking member.

A locking member 50 is mounted on a front surface of a right edge of the flange 27 as viewed from the rear. The locking member 50 is formed by press-molding a metal plate, such as spring steel. As shown in FIGS. 4, 5, and 8, the locking member 50 includes the above-referenced locking piece 51. The locking piece 51 has left and right spaced-apart arms 52 and a connection plate 53 that joins upper ends of the arms 52 to define a U-shape. A locking projection 55 is formed on an upper surface of each arm 52 of the locking piece 51. The locking projections 55 lock the to-be-locked plate 13 formed at a side edge of the mounting hole 12 of the bracket 10. A steep locking surface 56 is formed at a lower end of the locking projection 55 and an inclined surface 57 is formed on an outer surface of the upper portion of the locking projection 55. The connection plate 53 is bent down toward the back of the locking piece 51 from an upper end of each arm 52 and has a guide surface 58 that is continuous and flush with the inclined surfaces 57 of the locking projections 55.

An insertion plate 60 joins the arms 52 and is bent perpendicularly down from the lower ends of the arms 52 so that an upper edge of the insertion plate 60 is continuous with an end of each arm 52. The insertion plate 60 is a rectangle that is slightly wider than the locking piece 51. A seat 61 projects from a central portion of the upper edge of the insertion plate 60 between the arms 52 and is flush with the insertion plate 60.

As shown in FIG. 5, left and right side edges at the leading end of the insertion plate 60 are chamfered obliquely to form guides 63. A cut-into portion 64 is formed on the left and right side edges of the insertion plate 60 in a region whose area is less than the half of the entire area of a region upward from the guide portion 63. The cut-into portion 64 becomes gradually wider toward the rear of the insertion plate 60.

A mounting surface 32 for the locking member 50 is formed at the front side of the flange 27 and at the right side of the housing 21. The mounting surface 32 is at a central portion of the flange 27 in a width direction (vertical direction in FIG. 5). A square mounting concavity 33 is recessed in the mounting surface 32 and opens to the right, as shown in FIG. 4. The width of the mounting concavity 33 is dimensioned to receive the locking piece 51 of the locking member 50 therein. The depth of the mounting concavity 33 is longer than the projected length of the seat 61 of the locking member 50.

An insertion groove 35 is formed at a bottom portion of the mounting concavity 33 for receiving the insertion portion 60 of the locking member 50. The insertion groove 35 extends from left and right side walls thereof to a rear wall thereof. Additionally, the insertion groove 35 has a height slightly larger than the thickness of the insertion portion 60, as shown in FIG. 4. As shown with a dashed line of FIG. 5, side portions 35A of the insertion groove 35 are shallow to such an extent that the left and right side edges of the insertion portion 60 disposed outside the locking piece 51 can enter therein, whereas a rear portion 35B of the insertion groove 35 is deep to such an extent that most of the front side (lower side) of the insertion portion 60 can enter therein.

A wide portion 36 is formed at approximately a front half of the insertion groove 35 for almost tightly receiving the cut-into portion 64 of the insertion portion 60. A narrow portion 37 is formed at the rear of the insertion groove 35 for almost tightly receiving the front of the insertion portion 60 therein. A tapered portion 38 is formed between the wide portion 36 and the narrow portion 37 and becomes gradually narrower toward the rear end of the insertion groove 35.

Two guide walls 40 are formed on a front side of a portion of the flange 27 that projects on a right peripheral surface of the housing 21. The guide walls 40 align with side edges of the mounting concavity 33 and function to guide a pivotal motion of the connector 20 when inserting the connector 20 into the mounting hole 12, as explained below.

A circular arc-shaped portion 41 is defined on approximately one half of each guide wall 40 near the flange 27, as shown in FIG. 4. The circular arc-shaped portion 41 has a center at the sandwiching portion 30 and a radius equal to the interval between the left side edge of the mounting hole 12 and the to-be-locked plate 13 disposed at the right side edge of the mounting hole 12. An escaping portion 42 is defined at approximately the remaining half of the projected portion of the guide wall 40 and is disposed inward to prevent the guide wall 40 from interfering with to-be-locked plate 13.

The locking member 50 initially is mounted on the connector 20. More particularly, the insertion portion 60 of the locking member 50 is inserted into the insertion groove 35 on the flange 27 of the housing 21, as shown with arrow lines in FIGS. 4 and 5. The locking member 50 is inserted smoothly into the insertion groove 35, with the insertion portion 60 and the seat 61 sliding on the mounting concavity 33 and on the bottom surface of the insertion groove 35. The cut-into portion 64 of the insertion portion 60 reaches the narrow portion 37 disposed on the side surface of the insertion groove 3 near the end of the operation of mounting the connector 20 on the bracket 105. As a result, each cut-into portion 64 is press-fit into the corresponding side-wall side groove 35A with the cut-into portion 64 cutting into the side surface of the side-wall side groove 35A. The insertion operation is stopped when the front end of the insertion portion 60 strikes the rear surface of the rear-wall side groove 35B. At this time, the cut-into portion 64 acts as a catch. Thus, the locking member 50 is mounted irremovably on the rear-wall side groove 35B.

At this time, as shown in FIG. 9, the locking piece 51 projects forward at a right angle to the front surface of the flange 27. The interval between the front surface of the flange 27 and the locking surface 56 of the locking projection 55 formed on the locking piece 51 and the interval between the surface of the bracket 10 and the to-be-locked edge 14 of the to-be-locked plate 13 are set almost equally to each other.

The connector 20 with the locking member 50 mounted thereon is positioned so that the front fit-in portion 25 is in an oblique posture and facing sideways, as shown in FIG. 9. The connector 20 then is inserted into the mounting hole 12 of the bracket 10 from the rear. Thereafter the left side edge of the bracket 10 at the mounting hole 12 is retained by the sandwiching portion 30. In this state, the connector 20 is pivoted counterclockwise about the sandwiching portion 30 in FIG. 8 to allow the connector 20 to be vertical.

Figure 10:
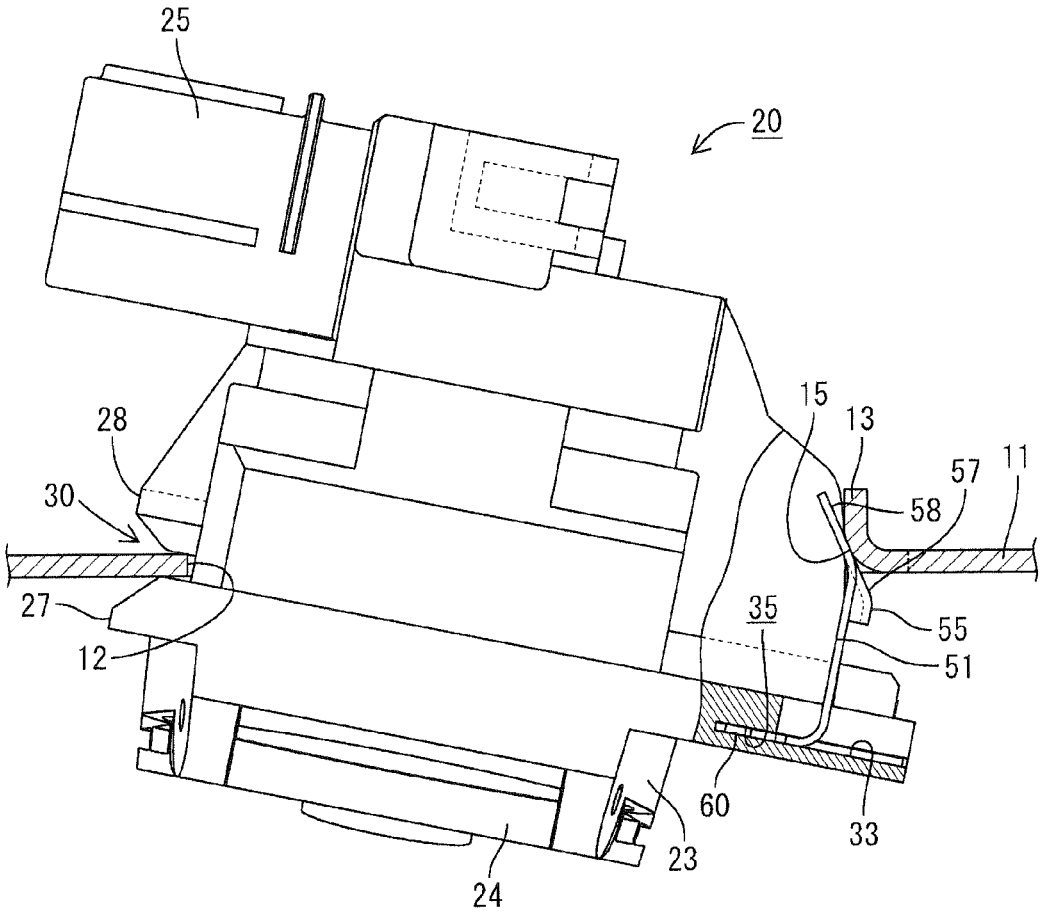
FIG. 10 is a partly cut-away plan view showing a last stage in the operation of mounting the connector on the bracket.

The circular arc-shaped portions 41 of the guide walls 40 strike and slide on the upper and lower ends of the to-be-locked plate 13 at the right side of the mounting hole 12, as the connector 20 pivots farther. As shown in FIG. 10, the guide surface 58 disposed at the upper end of the locking piece 51 strikes the rounded portion 15 disposed at the proximal end of the to-be-locked plate 13 as the operation of pivoting the connector 20 progresses further. The inclined surface 57 of the locking projection 55 rides on the rounded portion 15 and the locking piece 51 is deformed elastically inward. Thus, the locking projection 55 moves forward and slides on the inner surface of the to-be-locked plate 13.

Figure 11:
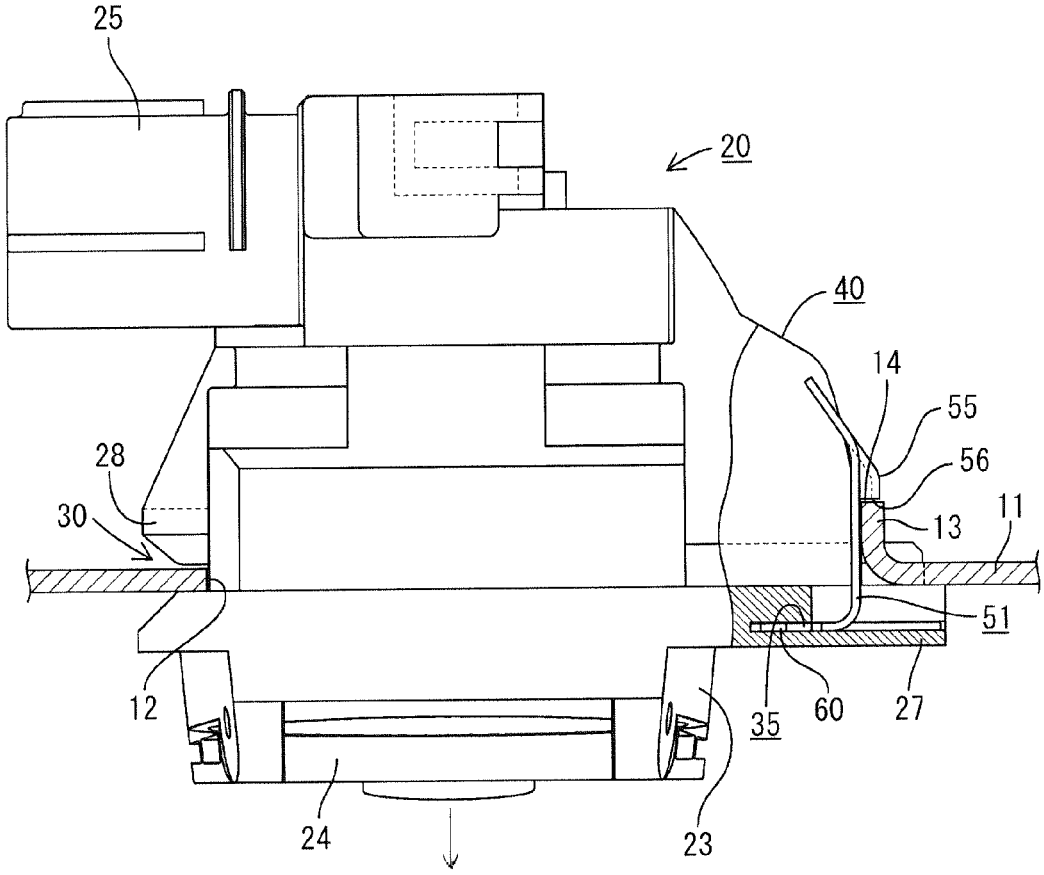
FIG. 11 is a partly cut-away plan view showing a state in which the connector has been mounted on the bracket.

The right side edge of the flange 27 strikes a surface forward of the right edge of the mounting hole 12 when the connector 20 is pivoted into a vertical posture, as shown in FIG. 11. Thus, further pivotal motion of the connector 20 is stopped. At that time, the locking projection 55 of the locking piece 51 passes the to-be-locked edge 14 of the to-be-locked plate 13 and the locking piece 51 returns resiliently to its original state. As a result, the locking surface 56 of the locking projection 55 locks the to-be-locked edge 14 of the to-be-locked plate 13. The left side edge of the mounting hole 12 is retained by the left side of the connector 20 at the sandwiching portion 30. Thus, the connector 20 is mounted unremovably on the body plate 11 of the bracket 10.

The connector drawn out of the car V is fit in the forwardly facing front fit-in portion 25 of the connector 20. The connector at the trailer side then is fit in and connected to the rear fit-in portion 23 with the opening and closing lid 24 opened.

The embodiment provides the following advantages.

A rearward directed pull force acts on the connector 20 when the wire harness drawn out of the trailer is pulled while the connector at the end of the wire harness is fit in the rear fit-in portion 23 of the connector 20, as shown with the arrow line of FIG. 11. As a result, the connector 20 applies a forward directed load to the locking piece 51 of the lock 50. The insertion portion 60 is bent perpendicularly from the lower end of the locking piece 51 and is inserted into the insertion groove 35 on the peripheral surface of the connector 20 in the direction orthogonal to the axial direction of the connector 20. Therefore even if a large force acts on the connector 20 in a removal direction, the insertion portion 60 is received by the insertion groove 35 and in contact with the bottom of the insertion groove 35. Therefore the locking piece 51 is not likely to slip off the insertion groove 35 and the connector 20 can be mounted on the bracket 10 at a high mounting strength.

The insertion groove 35 is formed by utilizing the flange 27, namely, a dead space, and hence the insertion groove 35 can be deep for securely preventing the locking piece 51 from slipping off the insertion groove 35.

The locking piece 51 is formed at only one side of the connector 20 and the sandwiching portion 30 is formed at the opposite side for retaining the edge of the mounting hole 12. The connector 20 is inserted into the mounting hole 12 in an oblique posture so that one side edge of the mounting hole 12 is retained by the sandwiching portion 30. The connector 20 then is pivoted about the sandwiching portion 30 and into a vertical posture. Thus, the locking piece 51 is locked elastically to the to-be-locked plate 13 at the edge of the mounting hole 12 to mount the connector 20 on the bracket 10. The connector 20 is useful for a construction that has the front fit-in portion 25 projected sideways and makes it impossible to insert the connector 20 into the mounting hole 12 with a vertical posture.

The guide wall 40 is provided at the side of the connector 20 with the lock 51 for guiding the pivotal motion of the connector 20 so that the guide wall 40 contacts the to-be-locked plate 13 at the edge of the mounting hole 12 as the connector 20 is pivoted about the sandwiching portion 30. Therefore the connector 20 can be mounted smoothly and quickly on the bracket 10.

The invention is not limited to the embodiments described above with reference to the drawings. For example, the following embodiments are also included in the technical scope of the present invention.

The locking piece may be constructed in a direction reverse to the direction in which the locking piece is constructed in the above-described embodiment. Specifically it is possible to adopt a construction in which the locking piece is extended rearward on the periphery of the connector in the shape of a cantilever from the front end of the connector in the insertion direction of the locking piece, and the extended end of the locking piece elastically locks the edge of the mounting hole at the front side (back side) thereof, with the extended end of the locking piece applied thereto.

The insertion groove into which the insertion portion of the locking piece is inserted is not limited to the flange exemplified in the above-described embodiment, but may be formed at other positions of the peripheral surface of the connector.

To unremovably insert the insertion portion of the locking piece, in addition to press fit, it is possible to use a locking construction of elastically locking the insertion portion of the locking piece with a locking piece.

In the above-described embodiment, only one side of the connector is elastically locked. But when the connector is so configured as to be inserted into the mounting hole of the bracket with the connector having a vertical posture, both sides of the connector may be locked to the locking piece. In this case, it is possible to mount the connector on the bracket in one touch.

The invention is applicable to connectors for uses other than a connector for towing a car.

The invention is applicable to a connector mounted on a panel other than a mounting plate at a lower rear end of a car.

What is claimed is:

1. A connector-mounting construction comprising:

a bracket with opposite front and rear surfaces and a mounting hole extending through the bracket from the front surface to the rear surface, a to-be-locked plate bent forward from the bracket adjacent to the mounting hole, the to-be-locked plate having a forwardly facing to-be-locked edge;

a connector with a front end configured for insertion through the mounting hole of the bracket and a rear end defining a fit-in portion configured for connection with a mating connector, a flange on a periphery of the connector and dimensioned contacting the rear surface of the bracket substantially adjacent an edge of the mounting hole, an insertion groove extending into the connector in a direction approximately orthogonal to direction between the front and rear ends of the connector; and a metal lock having an insertion portion disposed in the insertion groove and a locking piece projecting forward from the insertion portion and substantially along a periphery of the connector, the locking piece having at least one resiliently deformable locking projection with a rearwardly facing locking surface (56) configured for locking the forwardly facing to-be-locked edge of the bracket substantially adjacent an edge of said mounting hole when the flange of the connector contacts the rear surface of the bracket.

2. The connector-mounting construction of claim 1, wherein the insertion groove is formed on the flange of the connector.

3. The connector-mounting construction of claim 2, wherein said insertion portion of said lock is in press-fit engagement in the insertion groove.

4. The connector-mounting construction of claim 1, wherein the at least one locking projection comprises two locking projections at opposite sides of an axial line of the connector.

5. The connector-mounting construction of claim 1, wherein said lock is provided at a first side of the connector; and a projection is provided at a second side of the connector substantially opposite the lock, the projection and the flange sandwiching the edge of the bracket adjacent the mounting hole and at a position substantially opposite to the lock with respect to an axial line of the connector.

6. The connector-mounting construction of claim 5, wherein the connector has a guide is provided at the first side of the connector, the guide being configured for sliding in contact with an edge of the bracket adjacent the mounting hole as the connector is pivoted about a sandwiching portion between the flange and the projection.

* * * * *